US007891907B2

(12) United States Patent
Smith

(10) Patent No.: US 7,891,907 B2
(45) Date of Patent: Feb. 22, 2011

(54) DRAINAGE DEVICE

(75) Inventor: John Anthony Smith, Sheffield (GB)

(73) Assignee: Enverflow Ltd., Sheffield (GB)

( * ) Notice: Subject to any disclaimer, the term of this patent is extended or adjusted under 35 U.S.C. 154(b) by 146 days.

(21) Appl. No.: 11/989,006

(22) PCT Filed: Jul. 18, 2005

(86) PCT No.: PCT/GB2005/002803

§ 371 (c)(1),
(2), (4) Date: Feb. 27, 2009

(87) PCT Pub. No.: WO2007/010172

PCT Pub. Date: Jan. 25, 2007

(65) Prior Publication Data

US 2009/0202301 A1 Aug. 13, 2009

(51) Int. Cl.
*E04D 13/04* (2006.01)

(52) U.S. Cl. ..... 405/36; 405/40; 52/11; 52/16

(58) Field of Classification Search ..... 405/36, 405/39, 40, 41; 52/11, 13, 15, 16
See application file for complete search history.

(56) References Cited

U.S. PATENT DOCUMENTS 4,619,554 A * 10/1986 Walker et al. ..... 52/16
4,798,028 A * 1/1989 Pinion ..... 52/16
4,956,948 A * 9/1990 Hart ..... 52/16
6,185,889 B1 * 2/2001 Gilgan et al. ..... 52/16
6,537,446 B1 * 3/2003 Sanguinetti ..... 210/163
D475,440 S * 6/2003 Sawyer ..... D23/267
6,584,733 B2 * 7/2003 Wade ..... 52/16
6,755,966 B1 6/2004 Reed
7,096,627 B2 * 8/2006 Wade ..... 52/16
D589,599 S * 3/2009 Castrillo ..... D23/267
D596,273 S * 7/2009 Porter ..... D23/267
7,631,471 B2 * 12/2009 Grunewald et al. ..... 52/16
2005/0138875 A1 * 6/2005 Grunewald et al. ..... 52/302.1

FOREIGN PATENT DOCUMENTS

EP 1 160 390 12/2001
GB 891 630 3/1962
GB 2 327 370 1/1999

OTHER PUBLICATIONS

International Search Report Apr. 6, 2006.

* cited by examiner

*Primary Examiner*—Frederick L Lagman
(74) *Attorney, Agent, or Firm*—Nixon & Vanderhye

(57) ABSTRACT

Drainage device having an inlet having at least three substantially straight sides with rounded corners linking the at least three substantially straight sides. The sides and corners taper to form a circular outlet. The rounded corners are upper edges of channels of the device, and the channels are depressions in the sides.

15 Claims, 2 Drawing Sheets

DRAINAGE DEVICE

This application is the U.S. national phase of International Application No. PCT/GB2005/002803 filed 18 Jul. 2005, the entire contents of which is hereby incorporated by reference.

The present invention relates to a drainage device, particularly to a high capacity rainwater drainage device.

BACKGROUND OF THE INVENTION

Rainwater drainage devices are used to facilitate the drainage of rainwater from an elevated area, such as a rooftop, to a less elevated area, such as ground level, in a controlled, predictable manner.

When selecting a drainage device, there are a number of factors to be considered. Perhaps the most important factor to consider when selecting a drainage device for a particular use, is that the throughput capacity of the device is sufficient to facilitate the drainage an of adequate amount of rainwater from the drainage area. If this requirement is not met, then flooding can occur which can endanger individuals and lead to the substantial damage of property.

SUMMARY OF THE INVENTION

Drainage devices known in the art comprise a large circular inlet that tapers to a smaller circular outlet, which outlet is normally connected to a drainage pipe that allows the transport of the rainwater to a desired location, such as a central drain. Such devices are often countersunk into drainage gullies on rooftops. In use, rainwater falling onto the roof will flow into the drainage gully (by gravity) and drain through the drainage device.

The capacity of a rainwater drainage device is its ability to drain a unit of rainwater per unit time, for example, litres per second. One phenomenon known to reduce the throughput capacity of a drainage device is a vortex. A vortex occurs when the drained rainwater does not travel directly into the outlet, but instead adopts a spiral path from the inlet to the outlet. This means that the rainwater resides in the drainage device longer, thus less litres per second are drained.

One way to try and prevent the formation of vortices is by placing an anti vortex plate (which is generally a plate of sheet material) in or just above the drainage device to disturb the flow of the rainwater passing therethrough. However, this requires further parts to be fitted to the drainage device which, on a rooftop having a large number of drainage devices, results in a lot more materials used and more work required in fitting. Also, because the flow of liquid is disturbed by the anti vortex plate, the flow and thus the throughput capacity of the unit incorporating the anti vortex plate may be reduced by the use of a vortex plate.

It is an object of aspects of the present invention to attempt to overcome at least one of the above or other problems.

According to a first aspect of the present invention there is provided a drainage device comprising an inlet having at least three substantially straight sides with rounded corners linking said at least three substantially straight sides, wherein the sides and corners taper to form a circular outlet.

Preferably, the drainage device is a rainwater drainage device.

Advantageously, because the inlet has substantially straight sides, the likelihood of the formation of vortices is reduced without the need of an anti vortex plate.

Preferably, the inlet comprises at least four substantially straight sides. Preferably, the inlet comprises between 3 and 10 substantially straight sides. Preferably, the device comprises between 3 and 6 substantially straight sides.

Preferably, the inlet comprises at least three substantially straight sides of substantially the same length. Preferably, the inlet comprises at least four substantially straight sides of substantially the same length. In a particularly preferred embodiment, the inlet comprises four substantially straight sides of substantially the same length.

Preferably, the inlet is a parallelogram with rounded corners. Preferably, the inlet is a square inlet with rounded corners.

Preferably, the rounded corners are a quarter of a circle. Preferably, the radius of the rounded corners is similar to the radius of the outlet. Preferably, the radius of the rounded corners is substantially the same as the radius of the outlet.

Preferably, the diameter of the outlet is between 80 and 100 mm, more preferably between 85 and 95 mm and most preferably about 90 mm.

Preferably, the width of the inlet is about three times larger than the diameter of the outlet.

Preferably, at least two of the at least three substantially straight sides are parallel. Preferably, the distance between the parallel walls is about three times larger than the diameter of the outlet. Preferably, the distance between the parallel walls is between 250 and 300 mm, more preferably between 260 and 290 mm and most preferably between 270 and 280 mm.

In a particularly preferred embodiment, the inlet comprises a square with rounded corners and preferably the distance between the parallel sides of the inlet is between 250 and 300 mm, more preferably between 260 and 290 mm and most preferably between 270 and 280 mm.

Preferably, the inlet tapers to the outlet over a distance of between 100 and 140 mm, more preferably between 110 and 130 mm and most preferably about 120 mm.

Preferably, the inlet is laterally surrounded by an inlet flange. Preferably, the inlet flange comprises at least one fixing hole adapted to allow the flange to be secured to a surface.

Preferably, the outlet is laterally surrounded by an outlet flange. Preferably, the outlet flange is adapted to allow the outlet to be fixed to a pipe.

Preferably, the at least three substantially straight sides of the inlet are upper edges of at least three walls of the drainage device. Preferably, the rounded corners are upper edges of channels of the device, which channels are preferably arcuate in cross section. Preferably, the channels extend from the inlet to the outlet.

Preferably, the channels deter lateral flow of liquids passing through the drainage device. Preferably, the channels are depressions at the sides of the faces. Preferably, the channels are depressions at edges of the faces. Preferably, the channels are pinched at a point between the inlet and the outlet, preferably at substantially a mid-point between the inlet and the outlet.

Preferably, the taper from the inlet to the outlet is gradual at first, becomes increasingly severe and returns to a more gradual taper toward the outlet.

By the term gradual taper, it is meant that the inlet decreases in size slowly toward the outlet. Conversely, by the term severe taper it is meant that the inlet decreases in size rapidly toward the outlet.

Preferably, the slope of the taper generally follows a curve defined by the equation $y=x^3$.

Preferably, the walls make an angle of between 100° and 120° with the inlet flange, more preferably, between 105° and 115° and most preferably about 110°.

Preferably, the walls make an angle of between 60° and 85° with the outlet flange, more preferably 65° and 75° and most preferably about 80°.

Preferably, the inlet flange and the outlet flange are substantially parallel.

Preferably, the inlet flange is substantially planar. Preferably, the outlet flange is substantially planar.

Preferably, the taper of the walls at their most severe taper make an angle of at least 20° to the inlet flange. Preferably, the taper of the walls at their most severe taper make an angle of at least 25° to the inlet flange. Preferably, the taper of the walls at their most severe make an angle of between 20° and 50° to the inlet flange. Preferably, the taper of the walls at their most severe make an angle of between 25° and 40° to the inlet flange. Preferably, the taper of the walls at their most severe taper make an angle of about 30° to the inlet flange.

Preferably, the taper of the walls comprise no regions which are parallel to the inlet flange.

According to a second aspect of the present invention there is provided a drainage device having an inlet and an outlet having curved drainage surfaces between the inlet and the outlet, the curved drainage surfaces being generally tangential to the outlet with curves thereof forming a varying gradient from the inlet towards the outlet.

Preferably, the gradient follows a curve generally defined by the line $y=x^3$. Preferably, the gradient begins steeply at the inlet, then becomes shallower before returning to a steeper gradient toward the outlet.

Preferably, the gradient is always negative. By the term "the gradient is always negative" it is meant that the gradient always flows from the inlet to the outlet without any points where the gradient is parallel to the plane of the inlet.

Preferably, drainage channels are formed between the curved drainage surfaces. Preferably, the curved drainage surfaces form sidewalls of the drainage channels. Preferably, the drainage channels comprise a narrowed section partway along their length. Preferably, the drainage channels comprise a waist section.

Preferably, the drainage channels flare toward the outlet. Preferably, the drainage channels have a curved cross section. Preferably, the curve is generally a quarter of a circle. Preferably, the curve has a radius of curvature greater than the width of the channel. Preferably, the drainage channels are adapted to deter lateral flow within the drainage device. Preferably, the drainage channels are adapted to deter flow across their width. Preferably, the drainage channels are adapted to encourage flow along a longitudinal axis thereof. Preferably, the drainage channels are adapted to direct flow directly between the inlet and the outlet.

All of the features described herein may be combined with any of the above aspects and in any combination.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION OF PREFERRED EMBODIMENTS

Figure 1:
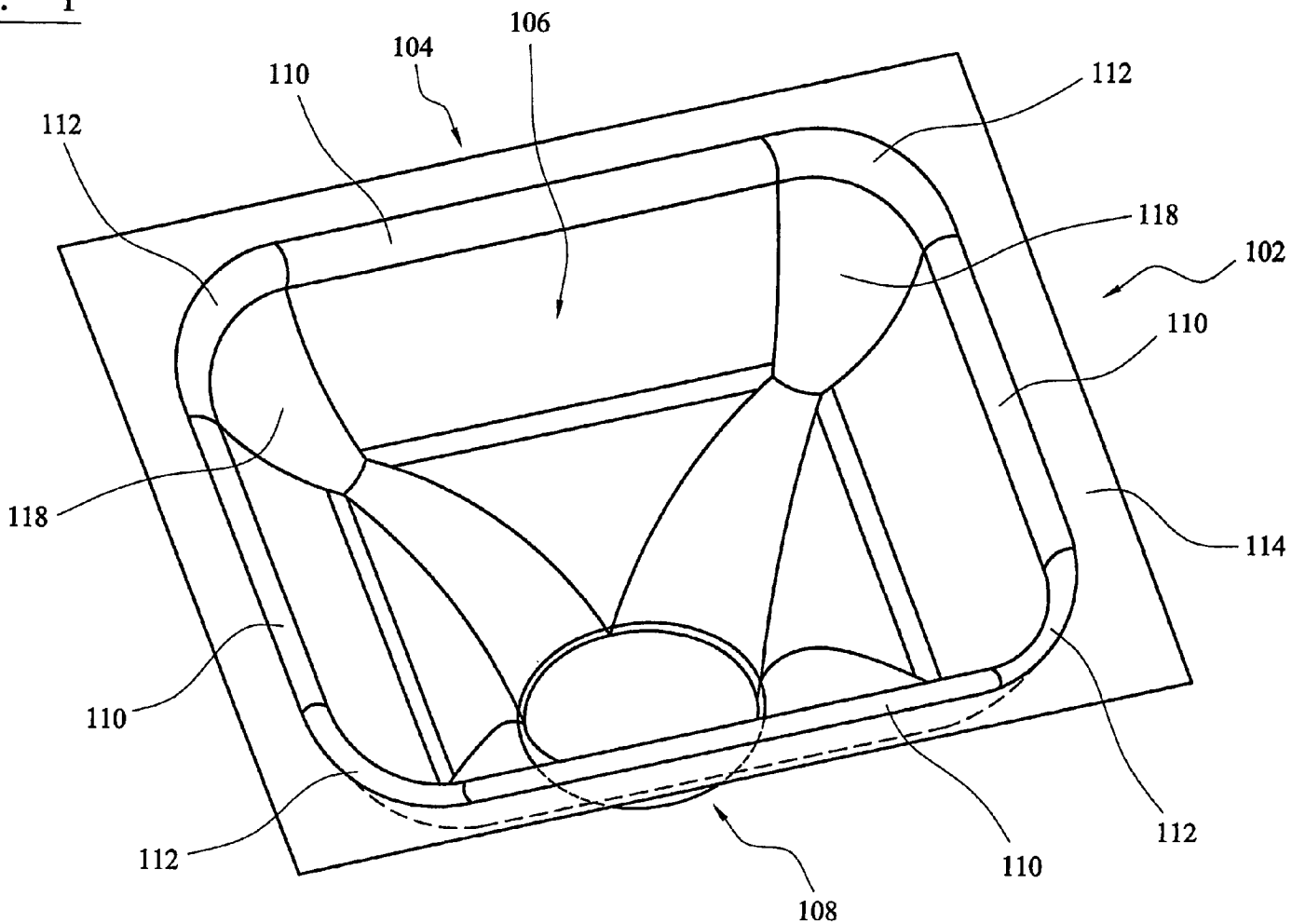
FIG. 1 shows a perspective schematic view of a drainage device.
Figure 2:
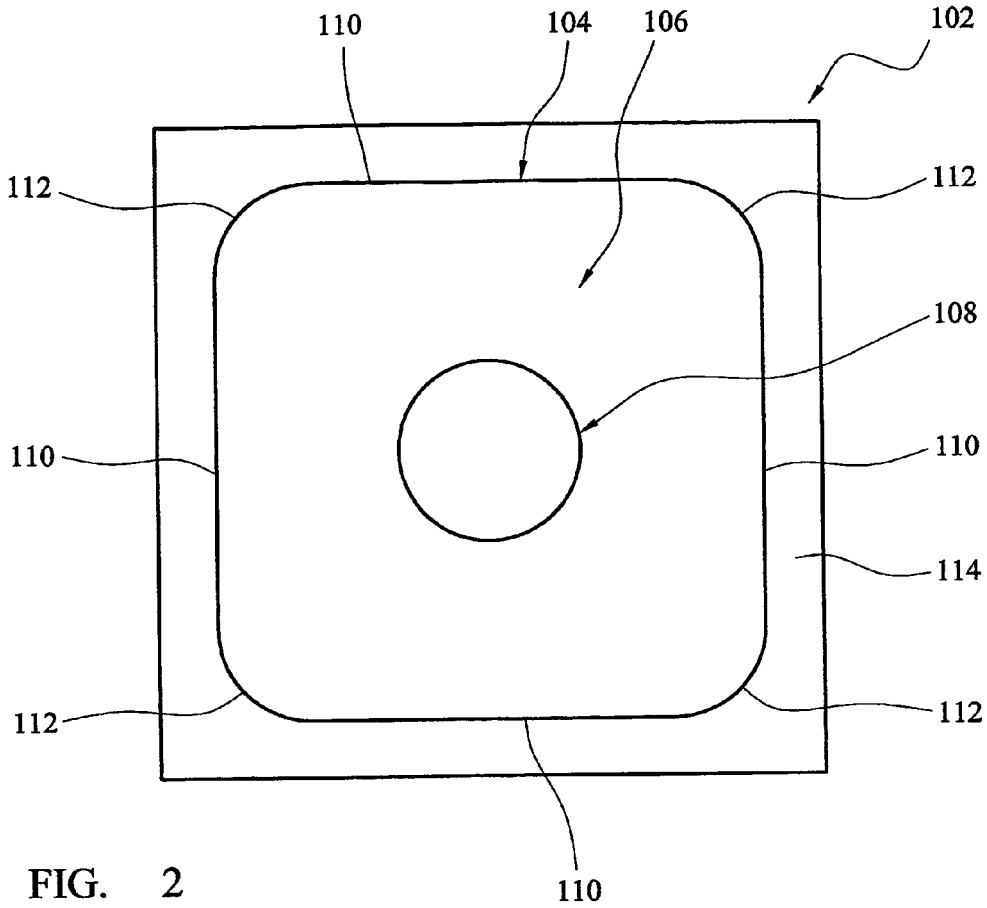
FIG. 2 shows a plan view of the drainage device.
Figure 3:
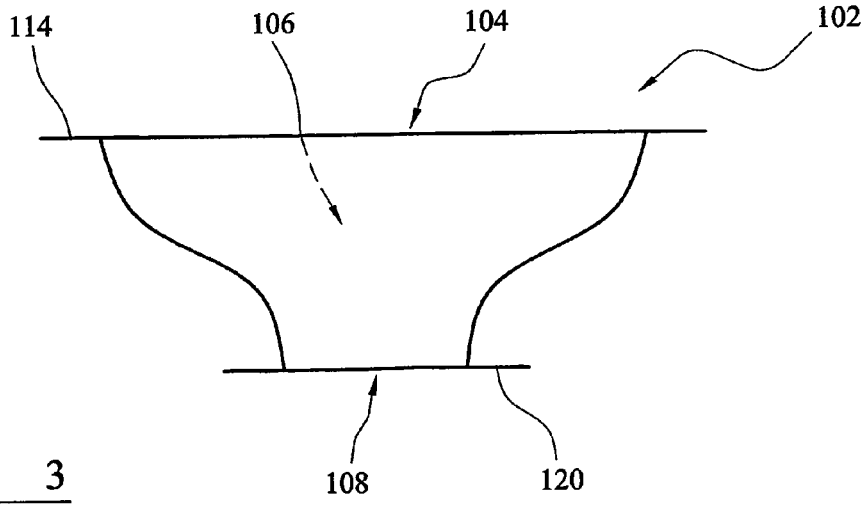
FIG. 3 shows a side view of the drainage device.

Referring to FIGS. 1, 2 and 3 there is shown a drainage device 102 having an inlet aperture 104, an interior volume 106 and a circular outlet aperture 108.

The inlet aperture 104 has the shape of a square having rounded corners. In more detail, the inlet aperture has four walls 110, each being opposite and parallel with a corresponding other of the four walls 110. The walls 110 are joined at edges thereof by four arcuate sections 112. The arcuate sections 112 are each approximately a quarter of a circle in shape and have a radius of approximately 15% of the width of the aperture. The aperture is surrounded by a square flange 114 to allow the device 102 to be fixed to a surface (not shown). The device 102 may be secured by a number of methods known in the art such as welding, gluing etc.

The walls 110 extend downwardly toward the outlet aperture 108. In more detail, and referring now particularly to FIG. 3, extending toward the outlet aperture 108 from the inlet aperture 104, the walls 106 taper at first gently, then progressively more severely, before gradually becoming less severe toward the outlet aperture 108. In other words, when viewed from a side as in FIG. 3, the walls of the interior volume are "S" shaped in profile.

The arcuate sections 112 extend in the form of channels 118 from the corners of the inlet aperture 104 to form the circular outlet aperture 108. The channels 118 act to guide any liquid passed through the drainage unit directly to the outlet aperture 108 as will be discussed below.

The outlet aperture 108 is laterally surrounded by a flange 120 extending away from the outlet, generally parallel to the square flange 114, to allow the outlet to be secured to a drainage pipe (not shown).

In use, the drainage device 102 is countersunk into a low point in a drainage gully, so that rainwater will flow under gravity toward and into the device 102. The device is secured to the drainage gully by fixing it via the flange 114. Rainwater flowing into the device 102 is discouraged from forming vortices which would slow the flow therethrough (as discussed above) by virtue of the none circular nature of the internal volume of the device 102. Further, the channels 118 serve to direct the flow of rainwater to increase the velocity of the water drained using the device 102. This may be exemplified by reference to the following experiments.

Experimental

A drainage device as described above, having a 90 mm diameter outlet was tested using a test rig. This test resulted in a maximum flow rate of 34 litres per second. This was compared to a prior art drainage device as disclosed in GB 2,269,402 having a circular inlet aperture which tapers to a circular outlet aperture being 75 mm in diameter and which incorporates an anti vortex plate. The test of the prior art device resulted in a maximum flow rate of 27 litres per second.

It can therefore be seen that the maximum flow rate of the device of the present application (which does not contain an anti vortex plate is 26% greater than that of a prior art device having an outlet 20% smaller and which prior art device includes an anti vortex plate. This increased performance is due to the increased velocity of the rainwater passing through the outlet aperture because of the non-circular shape of the interior volume of the device acting to prevent the formation of vortices and the channels providing a direct pathway between the inlet aperture and the outlet aperture.

Therefore, a drainage device made in accordance with the present invention is more efficient at draining liquids than prior art drainage devices. This results in fewer drainage devices being required per unit square of a drainage area, for example a roof of a building, which means that less work and materials are needed to supply adequate drainage to a roof. Also, each drainage point is a potential site for a leak to develop because each drainage point is a hole in the roof. A roof fitted with drainage devices of the present invention therefore provides fewer potential leakage points.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A drainage device comprising an inlet having at least three substantially straight sides with rounded corners linking said at least three substantially straight sides, wherein the sides and corners taper to form a circular outlet, wherein the rounded corners are upper edges of channels of the device, and wherein the channels are depressions in the sides.

2. A drainage device as claimed in claim 1, wherein the drainage device is a rainwater drainage device.

3. A drainage device as claimed in claim 1, which comprises between 3 and 10 substantially straight sides.

4. A drainage device as claimed in claim 1 which comprises at least four substantially straight sides.

5. A drainage device as claimed in claim 1 which comprises at least three substantially straight sides of substantially the same length.

6. A drainage device as claimed in claim 1 which comprises four substantially straight sides of substantially the same length.

7. A drainage device as claimed in claim 1, wherein the rounded corners are each quarters of a circle.

8. A drainage device as claimed in claim 1, wherein the radius of the rounded corners is substantially the same as the radius of the outlet.

9. A drainage device as claimed in claim 1, wherein at least two of the at least three substantially straight sides are parallel.

10. A drainage device as claimed in claim 1, wherein the inlet is laterally surrounded by an inlet flange.

11. A drainage device as claimed in claim 1, wherein the at least three substantially straight sides of the inlet are upper edges of at least three walls of the drainage device.

12. A drainage device as claimed in claim 1, wherein the channels are arcuate in cross section.

13. A drainage device as claimed in claim 1, wherein the channels extend from the inlet to the outlet.

14. A drainage device as claimed in claim 1, wherein the channels deter lateral flow of liquids passing through the drainage device.

15. A drainage device as claimed in claim 1, wherein the channels are pinched at a point between the inlet and the outlet.

* * * * *